US010907481B2

(12) United States Patent
Hough et al.

(10) Patent No.: US 10,907,481 B2
(45) Date of Patent: Feb. 2, 2021

(54) PLATFORM COOLING CORE FOR A GAS TURBINE ENGINE ROTOR BLADE

(71) Applicant: United Technologies Corporation, Farmington, CT (US)

(72) Inventors: Matthew Andrew Hough, West Hartford, CT (US); Jeffrey S. Beattie, South Glastonbury, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 16/427,870

(22) Filed: May 31, 2019

(65) Prior Publication Data

US 2019/0316475 A1 Oct. 17, 2019

Related U.S. Application Data

(62) Division of application No. 15/021,991, filed as application No. PCT/US2014/053042 on Aug. 28, 2014, now Pat. No. 10,364,682.

(Continued)

(51) Int. Cl.
*F01D 5/18* (2006.01)

(52) U.S. Cl.
CPC ..... *F01D 5/187* (2013.01); *F05D 2240/81* (2013.01); *F05D 2260/201* (2013.01); *F05D 2260/202* (2013.01); *F05D 2260/2212* (2013.01)

(58) Field of Classification Search
CPC ..... F01D 5/187; F05D 2240/81; F05D 2260/201; F05D 2260/202; F05D 2260/2212
See application file for complete search history.

(56) References Cited

U.S. PATENT DOCUMENTS 6,139,258 A ‡ 10/2000 Lang, III ..... F01D 5/141 415/11
6,164,912 A ‡ 12/2000 Tabbita ..... F01D 5/186 416/97

(Continued)

FOREIGN PATENT DOCUMENTS

EP 1849965 ‡ 10/2007

OTHER PUBLICATIONS

The International Preliminary Report on Patentability for PCT Application No. PCT/US2014/053042, dated Mar. 31, 2016.‡

(Continued)

*Primary Examiner* — William M McCalister
(74) *Attorney, Agent, or Firm* — Carlson, Gaskey & Olds, P.C.

(57) ABSTRACT

A rotor blade according to an exemplary aspect of the present disclosure includes, among other things, a platform, an airfoil that extends radially from the platform, a first cooling core that extends at least partially inside the airfoil, a second cooling core inside of the platform, a first cooling hole that extends circumferentially between a mate face of the platform and the second cooling core, a second cooling hole that extends between a gas path surface of the platform and the second cooling core, the second cooling core radially disposed between the gas path surface and a non-gas path surface, and the second cooling core circumferentially disposed between the first cooling core and the mate face. A method of cooling a blade is also disclosed.

21 Claims, 3 Drawing Sheets

Related U.S. Application Data

(60) Provisional application No. 61/878,809, filed on Sep. 17, 2013.

(56) References Cited

U.S. PATENT DOCUMENTS 6,210,111 B1 ‡ 4/2001 Liang ..... F01D 5/187 415/11
6,402,471 B1 ‡ 6/2002 Demers ..... F01D 5/081 415/11
7,597,536 B1 ‡ 10/2009 Liang ..... F01D 5/147 415/115
7,625,172 B2 ‡ 12/2009 Walz ..... F01D 5/186 415/11
7,695,247 B1 ‡ 4/2010 Liang ..... F01D 5/186 416/19
8,109,725 B2 ‡ 2/2012 Abdel-Messeh ..... F01D 5/186 416/96
8,133,024 B1 ‡ 3/2012 Liang ..... F01D 5/187 415/11
8,157,527 B2 ‡ 4/2012 Piggush ..... F01D 5/187 416/97
8,206,114 B2 ‡ 6/2012 Spangler ..... F01D 5/187 416/19
8,356,978 B2 ‡ 1/2013 Beattie ..... F01D 5/18 416/19
2005/0095129 A1 ‡ 5/2005 Benjamin ..... F01D 5/187 416/97
2006/0024164 A1 ‡ 2/2006 Keith ..... F01D 5/081 416/97 R
2007/0020100 A1 ‡ 1/2007 Beeck ..... F01D 5/147 416/193 A
2007/0116574 A1 ‡ 5/2007 Itzel ..... F01D 5/082 416/19
2007/0134099 A1 ‡ 6/2007 Lee ..... F01D 5/22 416/193 A
2009/0041586 A1 ‡ 2/2009 Bacha ..... F01D 5/187 416/97 R
2009/0074562 A1 ‡ 3/2009 Self ..... F01D 5/187 415/115
2009/0202339 A1 ‡ 8/2009 Torii ..... F01D 5/18 415/115
2009/0269184 A1 ‡ 10/2009 Spangler ..... F01D 5/187 415/115
2010/0329888 A1 ‡ 12/2010 Nadvit ..... F01D 5/18 416/97
2011/0044795 A1 ‡ 2/2011 Chon ..... F01D 5/187 415/11
2011/0176929 A1 ‡ 7/2011 Ammann ..... F01D 5/186 416/97
2011/0186550 A1 ‡ 8/2011 Gannelli ..... B23H 1/04 219/69
2011/0229344 A1 ‡ 9/2011 Johnson ..... F01D 5/181 416/97
2011/0311369 A1 ‡ 12/2011 Ramachandran ..... F01D 5/186 416/97
2012/0014810 A1 ‡ 1/2012 Antunes ..... F01D 5/14 416/97 R
2012/0034102 A1 ‡ 2/2012 Boyer ..... F01D 5/187 416/97
2012/0070305 A1 ‡ 3/2012 Ammann ..... F01D 5/082 416/97
2012/0189424 A1 ‡ 7/2012 Propheter-Hinckley ..... F01D 11/005 415/1
2012/0263603 A1 ‡ 10/2012 Hada ..... F01D 5/187 416/97 R
2013/0156598 A1 ‡ 6/2013 Davis ..... F01D 5/082 416/96 R
2013/0205793 A1 ‡ 8/2013 Xu ..... F23R 3/06 60/754
2013/0209231 A1 ‡ 8/2013 Davis ..... F01D 9/041 415/115
2014/0321961 A1 ‡ 10/2014 Beattie ..... F01D 5/081 415/1

OTHER PUBLICATIONS

The Extended European Search Report for EP Application No. 14853976.0, dated Mar. 27, 2017.‡
International Search Report and Written Opinion of the International Searching Authority for International application No. PCT/US2014/053042 dated May 29, 2015.‡
International Search Report and Written Opinion for International Application No. PCT/US2014/053042 completed May 28, 2015.
International Preliminary Report on Patentability for International Application No. PCT/US2014/053042 dated Mar. 31, 2016.
Extended European Search Report for European Patent Application No. 14853976.0 completed Mar. 17, 2017.

‡ imported from a related application

PLATFORM COOLING CORE FOR A GAS TURBINE ENGINE ROTOR BLADE

CROSS-REFERENCE TO RELATED APPLICATION

This application is a divisional of U.S. patent application Ser. No. 15/021,991 filed Mar. 15, 2016, which is a National Stage Entry of International Application No. PCT/US14/53042 filed Aug. 28, 2014, which claims the benefit of U.S. Provisional Application No. 61/878,809 filed Sep. 17, 2013.

STATEMENT REGARDING FEDERALLY SPONSORED RESEARCH OR DEVELOPMENT

This invention was made with government support under Contract No. FA8650-09-D-2923 0021, awarded by the United States Air Force. The Government therefore has certain rights in this invention.

BACKGROUND

This disclosure relates to a gas turbine engine, and more particularly to a gas turbine engine rotor blade having a platform cooling core.

Gas turbine engines typically include a compressor section, a combustor section, and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections of a gas turbine engine may include alternating rows of rotating blades and stationary vanes that extend into the core flow path of the engine. For example, in the turbine section, turbine blades rotate to extract energy from the hot combustion gases. The turbine vanes direct the combustion gases at a preferred angle of entry into the downstream row of blades. Blades and vanes are examples of components that may need cooled by a dedicated source of cooling air in order to withstand the relatively high temperatures they are exposed to.

SUMMARY

A rotor blade according to an exemplary aspect of the present disclosure includes, among other things, a platform, an airfoil that extends from the platform, a first cooling core that extends at least partially inside the airfoil, a second cooling core inside of the platform and a first cooling hole that extends between a mate face of the platform and the second cooling core.

In a further non-limiting embodiment of the foregoing rotor blade, the second cooling core is fed with a cooling fluid from the first cooling core.

In a further non-limiting embodiment of either of the foregoing rotor blades, a passage fluidly connects the second cooling core with the first cooling core.

In a further non-limiting embodiment of any of the foregoing rotor blades, the second cooling core is fed with a cooling fluid from a pocket located radially inboard from the platform.

In a further non-limiting embodiment of any of the foregoing rotor blades, a passage fluidly connects the second cooling core with the pocket.

In a further non-limiting embodiment of any of the foregoing rotor blades, at least one augmentation feature is formed inside the second cooling core.

In a further non-limiting embodiment of any of the foregoing rotor blades, a second cooling hole extends between a gas path surface of the platform and the second cooling core.

In a further non-limiting embodiment of any of the foregoing rotor blades, the first cooling core is a main body cooling core and the second cooling core is a platform cooling core.

In a further non-limiting embodiment of any of the foregoing rotor blades, the second cooling core is formed near a trailing edge of the platform on either a suction side or a pressure side of the airfoil.

In a further non-limiting embodiment of any of the foregoing rotor blades, the second cooling core is formed near a leading edge of the platform on either a suction side or a pressure side of the airfoil.

A gas turbine engine according to an exemplary aspect of the present disclosure includes, among other things, a compressor section and a turbine section downstream from the compressor section. A rotor blade is positioned within at least one of the compressor section and the turbine section, the rotor blade including a platform, an airfoil that extends from the platform, a main body cooling core that extends inside the airfoil and a platform cooling core inside of the platform. The platform cooling core is fed with a cooling fluid from either the main body cooling core or a pocket radially inboard of the platform.

In a further non-limiting embodiment of the foregoing gas turbine engine, the platform cooling core is a pocket disposed radially between a gas path surface and a non-gas path surface of the platform.

In a further non-limiting embodiment of either of the foregoing gas turbine engines, a passage is formed in a neck of the rotor blade that fluidly connects the platform cooling core with the pocket.

In a further non-limiting embodiment of any of the foregoing gas turbine engines, a first cooling hole extends between a mate face of the platform and the platform cooling core.

In a further non-limiting embodiment of any of the foregoing gas turbine engines, a second cooling hole extends between a gas path surface of the platform and the platform cooling core.

A method of cooling a rotor blade of a gas turbine engine according to another exemplary aspect of the present disclosure includes, among things, communicating a cooling fluid into a platform cooling core of a platform of a rotor blade, expelling a first portion of the cooling fluid through a first cooling hole that extends through a mate face of the platform and expelling a second portion of the cooling fluid through a second cooling hole that extends through a gas path surface of the platform.

In a further non-limiting embodiment of the foregoing method, the method of communicating includes feeding the cooling fluid to the platform cooling core from a main body cooling core.

In a further non-limiting embodiment of either of the foregoing methods, the method of communicating includes feeding the cooling fluid to the platform cooling core from a pocket located exterior to the rotor blade.

In a further non-limiting embodiment of any of the foregoing methods, the method includes depositing a film cooling layer at the mate face to discourage gas ingestion into a mate face gap between adjacent rotor blades.

In a further non-limiting embodiment of any of the foregoing methods, the method includes depositing the film cooling layer at another mate face of the adjacent rotor blade.

The embodiments, examples and alternatives of the preceding paragraphs, the claims, or the following descriptions and drawings, including any of their various aspects or respective individual features, may be taken independently or in any combination. Features described in connection with one embodiment are applicable to all embodiments, unless such features are incompatible.

The various features and advantages of this disclosure will become apparent to those skilled in the art from the following detailed description. The drawings that accompany the detailed description can be briefly described as follows.

DETAILED DESCRIPTION

This disclosure relates to a gas turbine engine rotor blade that includes a platform cooling core. The platform cooling core can be fed with a cooling fluid supplied from a main body cooling core, a pocket located between adjacent rotor blades, or any other suitable location. Cooling fluid from the platform cooling core may be expelled through mate face cooling holes and/or platform cooling holes. These and other features are described in detail herein.

Figure 1:
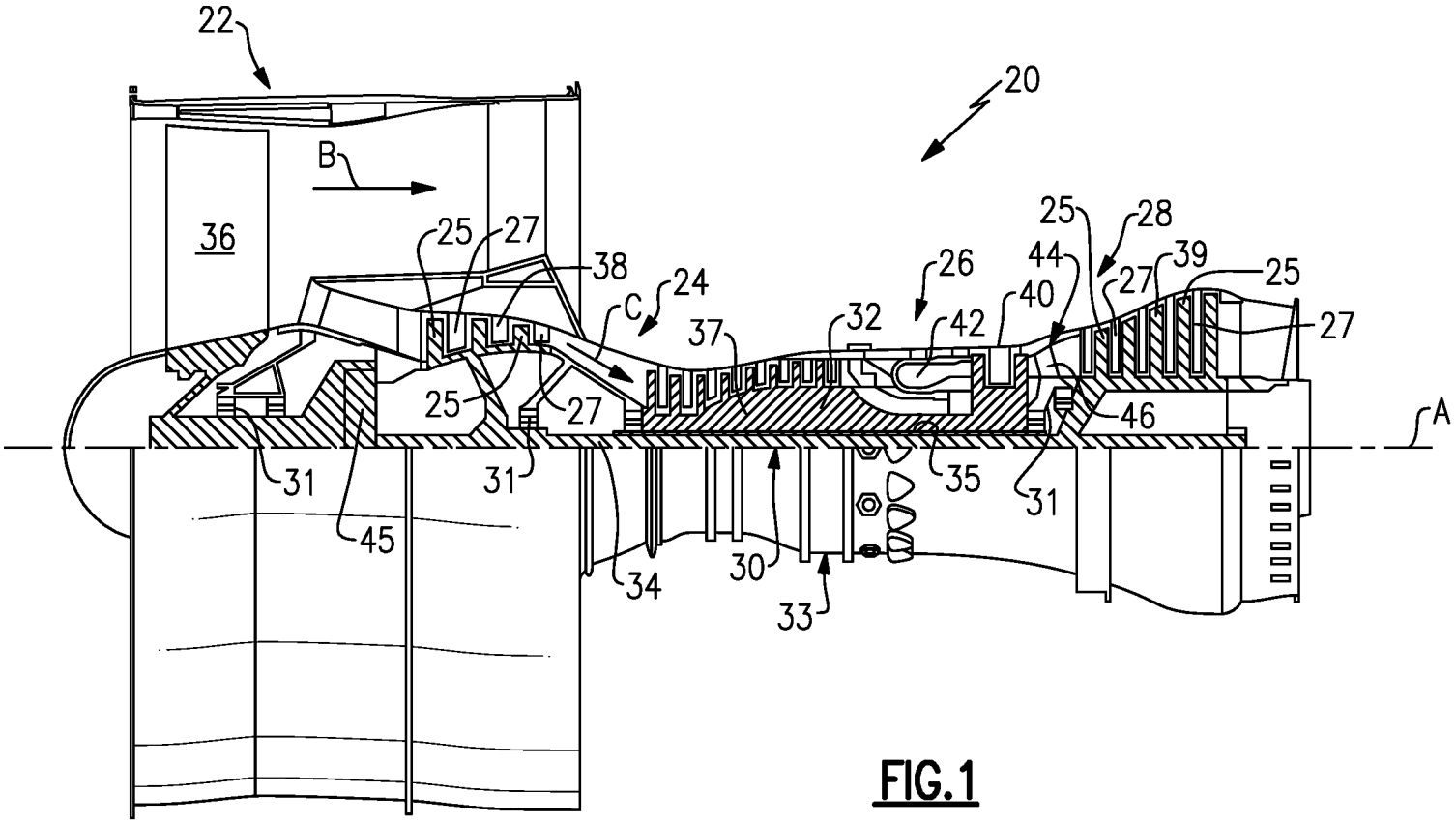
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems or features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in this non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only exemplary of one embodiment of a geared architecture engine and that the present disclosure is applicable to other gas turbine engines, including direct drive turbofans.

In this embodiment of the exemplary gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of $[(\text{Tram}^\circ\ \text{R})/(518.7^\circ\ \text{R})]^{0.5}$. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 create or extract energy (in the form of pressure) from the core airflow that is communicated through the gas turbine engine 20 along the core flow path C. The vanes 27 direct the core airflow to the blades 25 to either add or extract energy.

Various components of the gas turbine engine 20, including but not limited to the airfoil and platform sections of the blades 25 and vanes 27 of the compressor section 24 and the turbine section 28, may be subjected to repetitive thermal cycling under widely ranging temperatures and pressures. The hardware of the turbine section 20 is particularly subjected to relatively extreme operating conditions. Therefore, some components may require dedicated internal cooling circuits to cool the parts during engine operation. This disclosure relates to gas turbine engine components having platform cooling core fed mate face cooling holes that discourage hot gas ingestion in the mate face gap between adjacent rotor blades, as is further discussed below.

Figure 2:
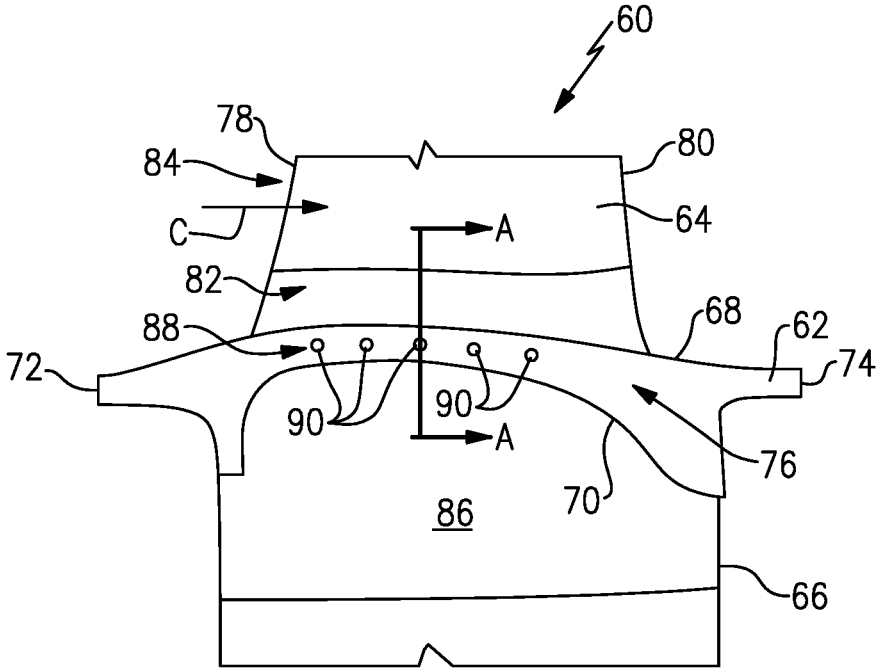
FIG. 2 illustrates a rotor blade that can be incorporated into a gas turbine engine.

FIG. 2 illustrates a rotor blade 60 that can be incorporated into a gas turbine engine, such as the compressor section 24 or the turbine section 28 of the gas turbine engine 20 of FIG. 1. The rotor blade 60 may be part of a rotor assembly (not shown) that includes a plurality of rotor blades circumferentially disposed about the engine centerline longitudinal axis A and configured to rotate to extract energy from the core airflow of the core flow path C.

The rotor blade 60 includes a platform 62, an airfoil 64, and a root 66. In one embodiment, the airfoil 64 extends from a gas path surface 68 of the platform 62 and the root 66 extends from a non-gas path surface 70 of the platform 62. The gas path surface 68 is exposed to the hot combustion gases of the core flow path C, whereas the non-gas path surface 68 is remote from the core flow path C.

The platform 62 axially extends between a leading edge 72 and a trailing edge 74 and circumferentially extends between a first mate face 76 and a second mate face (not shown). The airfoil 64 axially extends between a leading edge 78 and a trailing edge 80 and circumferentially extends between a pressure side 82 and a suction side 84.

The root 66 is configured to attach the rotor blade 60 to a rotor assembly, such as within a slot formed in a rotor assembly. The root 66 includes a neck 86, which is, in one embodiment, an outer wall of the root 66.

The rotor blade 60 may include a cooling scheme 88 that includes one or more cooling cores and cooling holes 90 (shown as mate face cooling holes in this example) formed in the airfoil 64 and platform 62 of the rotor blade 60. Exemplary cooling schemes are described in greater detail below with respect to FIGS. 3 and 4.

Figure 3:
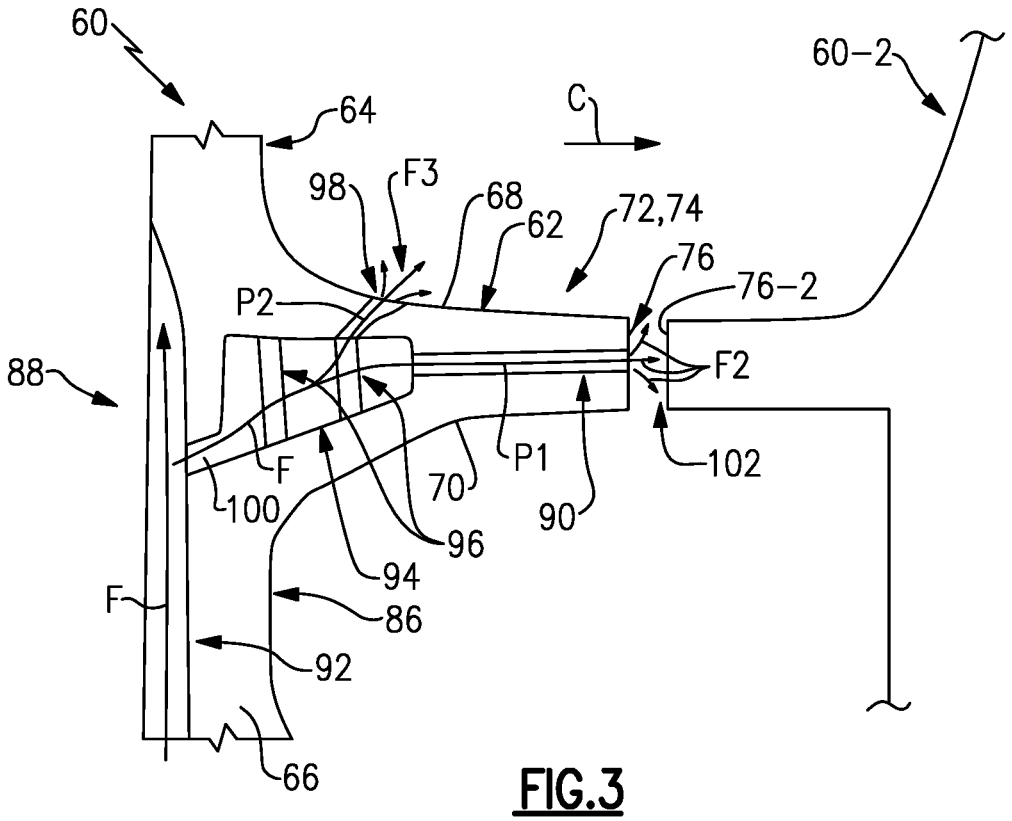
FIG. 3 is a view taken through section A-A of FIG. 2 and illustrates an exemplary cooling scheme of a rotor blade.

FIG. 3 illustrates a first embodiment of a cooling scheme 88 that can be incorporated into a rotor blade 60. In one embodiment, the cooling scheme 88 includes a main body cooling core 92 (i.e., a first cooling core or cavity) and a platform cooling core 94 (i.e., a second cooling core or cavity). Of course, additional cooling cores can be formed inside of the rotor blade 60. In one embodiment, the main body cooling core 92 and/or the platform cooling core 94 are made using ceramic materials. In another embodiment, the main body cooling core 92 and/or the platform cooling core 94 are made using refractory metal materials. In yet another embodiment, the cores 92, 94 can be formed using both ceramic and refractory metal materials.

In one non-limiting embodiment, the main body cooling core 92 extends through the root 66 and at least a portion of the airfoil 64. The main body cooling core 92 can communicate a cooling fluid F, such as compressor bleed airflow, to cool the airfoil 64 and/or other sections of the rotor blade 60.

The platform cooling core 94 may be formed within the platform 62 and could be disposed adjacent to the pressure side 82 or the suction side 84 of the airfoil 64 (see FIG. 2). In one embodiment, the platform cooling core 94 is a pocket formed near the leading edge 72 of the platform 62. In another embodiment, the platform cooling core 94 is a pocket formed near the trailing edge 74 of the platform 62. The platform cooling core 94 is radially disposed between the gas path surface 68 and the non-gas path surface 70 and circumferentially disposed between the main body cooling core 92 and the mate face 76, in another embodiment.

One or more augmentation features 96 may be formed inside the platform cooling core 94. The augmentation features 96 may alter a flow characteristic of the cooling fluid F circulated through the platform cooling core 94. For example, pin fins, trip strips, pedestals, guide vanes etc. may be placed within the platform cooling core 94 to manage stress, gas flow and heat transfer.

The cooling scheme 88 may additionally include a plurality of cooling holes 90, 98 that are drilled or otherwise manufactured into the rotor blade 60. For example, a first cooling hole 90 may extend between the mate face 76 and the platform cooling core 94. The first cooling hole 90 may be referred to as a mate face cooling hole. A second cooling hole 98 may extend between the gas path surface 68 of the platform 62 and the platform cooling core 94. The second cooling hole 98 may be referred to as a platform cooling hole. It should be understood that additional cooling holes could be disposed through both the platform 62 and the mate face 76.

In this embodiment, the platform cooling core 94 is fed with a portion of the cooling fluid F from the main body cooling core 92. A passage 100 may fluidly connect the platform cooling core 94 with the main body cooling core 92.

Once inside the platform cooling core 94, the cooling fluid F may circulate over, around or through the augmentation features 96 prior to being expelled through the cooling holes 90, 98. In one non-limiting embodiment, a first portion P1 of the cooling fluid F is expelled through the first cooling hole 90 to provide a layer of film cooling air F2 at the mate face 76. The layer of film cooling air F2 expelled from the first cooling hole 90 discourages hot combustion gases from the core flow path C from ingesting into a mate face gap 102 that extends between the mate face 76 of the rotor blade 60 and a mate face 76-2 of a circumferentially adjacent rotor blade 60-2. In another embodiment, a second portion P2 of the cooling fluid F is expelled through the second cooling hole 98 to provide a layer of film cooling air F3 at the gas path surface 68 of the platform 62.

Figure 4:
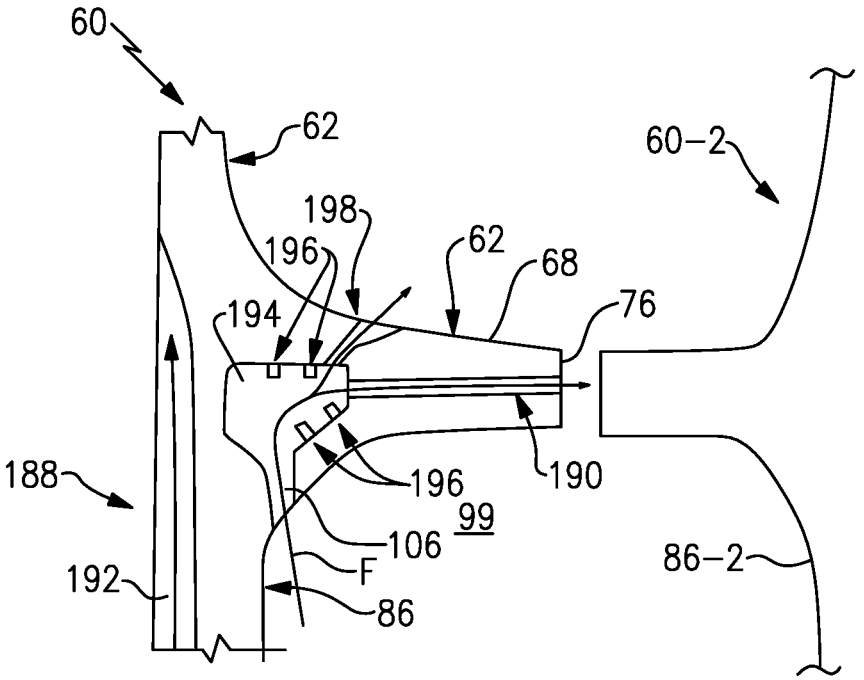
FIG. 4 illustrates another exemplary cooling scheme of a rotor blade.

FIG. 4 illustrates another cooling scheme 188 that can be incorporated into a rotor blade 60. In this disclosure, like reference numerals represent like features, whereas reference numerals modified by 100 are indicative of slightly modified features.

In this particular embodiment, the cooling scheme 188 includes a main body cooling core 192 and a platform cooling core 194. The platform cooling core 194 may be fluidly isolated from the main body cooling core 192. In other words, the platform cooling core 194 is not fed by the main body cooling core 192. Instead, the platform cooling core 194 is fed with a cooling fluid F taken from a pocket 99 that extends radially inboard of the platform 62. In other words, the pocket 99 is located exterior from the rotor blade 60. In one embodiment, the pocket 99 extends between the neck 86 of the rotor blade 60 and a neck 86-2 of an adjacent rotor blade 60-2. This may be referred to as a "poor man fed" design. The platform cooling core 194 could be fed from any number of locations depending on the particular design and environment in which the component is to be utilized.

A passage 106 formed in the neck 86 may connect the platform cooling core 194 with the pocket 99. The cooling fluid F is fed into the platform cooling core 194, circulated over augmentation features 196, and may then expelled through a first cooling hole 190 at a mate face 76 and a second cooling hole 198 at a gas path surface 68 of the platform 62.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A rotor blade, comprising:

a platform;

an airfoil that extends radially from said platform;

a first cooling core that extends at least partially inside said airfoil;

a second cooling core inside of said platform, wherein said second cooling core is fed with a cooling fluid from said first cooling core;

a first cooling hole that extends circumferentially between a mate face of said platform and said second cooling core;

a second cooling hole that extends between a gas path surface of said platform and said second cooling core;

a plurality of augmentation features circumferentially distributed along a radially extending wall of said second cooling core, each one of the plurality of augmentation features extending radially between opposed walls of said second cooling core; and wherein said second cooling core is radially disposed between said gas path surface and a non-gas path surface, and said second cooling core is circumferentially disposed between said first cooling core and said mate face.

2. The rotor blade as recited in claim 1, comprising a passage that fluidly connects said second cooling core with said first cooling core.

3. The rotor blade as recited in claim 1, comprising at least one augmentation feature formed inside said second cooling core.

4. The rotor blade as recited in claim 3, wherein said at least one augmentation feature includes a plurality of augmentation features circumferentially distributed along a wall of said second cooling core.

5. The rotor blade as recited in claim 4, wherein said plurality of augmentation features are arranged such that the cooling fluid circulates over said plurality of augmentation features prior to being expelled through said first and second cooling holes.

6. The rotor blade as recited in claim 1, wherein said first cooling core is a main body cooling core and said second cooling core is a platform cooling core.

7. The rotor blade as recited in claim 1, wherein said second cooling core is formed near a trailing edge of said platform on either a suction side or a pressure side of said airfoil.

8. The rotor blade as recited in claim 1, wherein said second cooling core is formed near a leading edge of said platform on either a suction side or a pressure side of said airfoil.

9. The rotor blade as recited in claim 1, wherein said first cooling hole is a plurality of cooling holes including respective outlets distributed along said mate face.

10. The rotor blade as recited in claim 1, comprising a root that extends radially inward from said platform, wherein said airfoil extends radially outward from said platform, and said first cooling core extends at least partially inside said root.

11. A gas turbine engine, comprising:

a compressor section;

a turbine section downstream from said compressor section;

a rotor blade positioned within at least one of said compressor section and said turbine section, said rotor blade including:

a platform;

an airfoil that extends radially from said platform;

a main body cooling core that extends inside said airfoil;

a platform cooling core inside of said platform;

a first cooling hole that extends between a mate face of said platform and said platform cooling core;

a second cooling hole that extends between a gas path surface of said platform and said platform cooling core;

a plurality of augmentation features circumferentially distributed along a radially extending wall of said platform cooling core, each one of the plurality of augmentation features extending radially between opposed walls of said platform cooling core; and wherein said platform cooling core is fed with a cooling fluid from said main body cooling core.

12. The gas turbine engine as recited in claim 11, wherein said first cooling hole is a plurality of cooling holes including respective outlets distributed along said mate face.

13. The gas turbine engine as recited in claim 1, comprising a passage that fluidly connects said platform cooling core with said main body cooling core.

14. The gas turbine engine as recited in claim 1, wherein said plurality of augmentation features are arranged such that the cooling fluid circulates over said plurality of augmentation features prior to being expelled through said first and second cooling holes.

15. The gas turbine engine as recited in claim 11, wherein said platform cooling core is formed on a suction side of said airfoil.

16. The gas turbine engine as recited in claim 11, wherein said platform cooling core is formed on a pressure side of said airfoil.

17. A method of cooling a rotor blade of a gas turbine engine, comprising the steps of:

communicating a cooling fluid into a platform cooling core of a platform of a rotor blade, including feeding the cooling fluid to the platform cooling core from a main body cooling core;

expelling a first portion of the cooling fluid through a first cooling hole that extends through a mate face of the platform;

providing a plurality of augmentation features circumferentially distributed along a radially extending wall of said platform cooling core, each one of the plurality of augmentation features extending radially between opposed walls of said platform cooling core; and expelling a second portion of the cooling fluid through a second cooling hole that extends through a gas path surface of the platform.

18. The method as recited in claim 17, comprising depositing a film cooling layer at the mate face to discourage gas ingestion into a mate face gap, the mate face gap defined between the mate face and another mate face of an adjacent rotor blade.

19. The method as recited in claim 17, wherein the first cooling hole is a plurality of cooling holes including respective outlets distributed along the mate face.

20. The gas turbine engine as recited in claim 14, wherein:

said airfoil extends axially between a leading edge and a trailing edge, said first cooling hole is a plurality of first cooling holes, and each one of said plurality of first cooling holes is axially forward of said leading edge of said airfoil; and said plurality of augmentation features are trip strips, and one of said trip strips is circumferentially aligned with one of said second cooling holes.

21. The method as recited in claim 17, wherein:

said rotor blade includes an airfoil that extends radially from said platform; and said airfoil extends axially between a leading edge and a trailing edge, and the first cooling hole is axially forward of said leading edge of said airfoil.

* * * * *